United States Patent [19]

Kyytsönen

[11] Patent Number: 4,668,328

[45] Date of Patent: May 26, 1987

[54] APPARATUS FOR JOINING THE ENDS OF WEBS

[75] Inventor: Markku Kyytsönen, Numminen, Finland

[73] Assignee: Oy Wartsila AB, Finland

[21] Appl. No.: 753,337

[22] Filed: Jul. 9, 1985

[30] Foreign Application Priority Data

Jul. 11, 1984 [FI] Finland ..... 842802

[51] Int. Cl.[4] ..... B31F 5/00; B65H 19/18; B65H 19/20; G03D 15/04

[52] U.S. Cl. ..... 156/502; 156/157; 156/159; 242/58.4; 242/58.5

[58] Field of Search ..... 242/56 R, 58.5, 58.4; 156/157, 159, 502, 504, 505, 507; 29/281.1, 281.5

[56] References Cited

U.S. PATENT DOCUMENTS

| | | | |
|---|---|---|---|
| 4,010,911 | 3/1977 | Heitmann | 156/505 |
| 4,106,974 | 8/1978 | Hirsch | 156/507 |
| 4,108,391 | 8/1978 | Martinez | 156/505 |
| 4,190,475 | 2/1980 | Marschke | 156/504 |
| 4,450,039 | 5/1984 | Salvucci | 156/504 |
| 4,505,772 | 3/1985 | Renz | 156/523 |

*Primary Examiner*—Donald E. Czaja
*Assistant Examiner*—Merrell C. Cashion, Jr.
*Attorney, Agent, or Firm*—Steinberg & Raskin

[57] ABSTRACT

Method and apparatus for joining an end of a first web to an end of a second web by, for example, double-sided adhesive tape, glue or the like, include locking the end of the first web at a fixed position by first locking apparatus and locking, i.e., holding the end of the second web by second holding and moving apparatus. The held end of the second web is moved by the second apparatus into pressure contact with the end of the first web whereby the ends of the respective webs are joined to each other by adhesive tape, glue or the like.

11 Claims, 14 Drawing Figures

APPARATUS FOR JOINING THE ENDS OF WEBS

BACKGROUND OF THE INVENTION

The present invention relates to methods and apparatus for joining an end of a first web to an end of a second web by means of adhesive tape, preferably double-sided adhesive tape, glue or the like.

It often becomes necessary after the formation and/or treatment of web-like material, such as paper web material, to join the ends of webs in a so-called static joint, i.e., with the web being stationary. It is important to join the ends of the web in a manner such that the joint produced will not impair the runability of the resulting web during post-treatment operations. For example, it may be necessary to remove damaged or low-quality lengths of the web or add a new length of web material to an existing web.

Web joints of the type described above have in the past usually been formed by hand. The difficulty inherent in the joint-forming operation is that the web should be maintained in a relatively taut condition uniform over its broad width. It has also proven to be difficult to obtain a uniform quality in several joints formed in the same web. It is not uncommon for the quality of a joint to be so poor that the web will break in the area of the joint as the web is subjected to subsequent converting operations.

According to one known arrangement for joining the ends of webs to each other, a length of tape is attached to a machine roll anc the web cut a short distance from the tape. The tail of the web being pulled is folded over itself and torn along the margin of the tape. A protective band previously applied to the tape is then removed and the end of the pulley web is carried to the machine roll and pressed onto the tape. The tail of the pulley web is then folded and torn off. A joint formed in this manner can be aplied both in topside as well as underside running of the web.

SUMMARY OF THE INVENTION

An object of the present invention is to provide new and improved methods and apparatus for joining the ends of webs to each other.

Another object of the present invention is to provide new and improved methods and apparatus for joining the ends of webs to each other wherein the joints formed are of uniformly good quality.

Still another object of the present invention is to provide new and improved methods and apparatus for joining ends of webs wherein the web ends are held in a uniformly taut condition over the entire width of the webs during formation of the joint.

Briefly, in accordance with the present invention, these and other objects are attained by providing methods and apparatus wherein an end of a first web is locked in a fixed position by locking apparatus so that the marginal region of the end of the first web is disposed to form a joint with the marginal region of an end of a second web. The end of the second web is locked, i.e., held by holding and moving apparatus which then carry the marginal region of the end of the second web into pressure contact with the marginal region of the end of the first web to form a joint therewith using adhesive tape, glue, or the like.

In the particular illustrated embodiment, the ends of the first and second webs are locked and held, respectively during formation of the joint by means of suction and means are provided for carrying the end of the second web to the end of the first web while maintaining a substantially uniform tautness or tension over the broad width of the second web.

Several significant advantages are obtained by the methods and apparatus of the invention. For example, the joints which are formed in accordance with the invention are highly uniform in quality. Importantly, at least the web being pulled is maintained under a uniform tension over its entire width while the joint is being formd. The labor required for the joining of the web ends is significantly reduced with respect to conventional techniques. Additionally, in accordance with the invention, the tails or marginal regions of the web ends being joined can have any desired length which may be varied in accordance with the particular application. Indeed, the method and apparatus of the invention has a wide range of aplications. For example, the invention may be utilized on various types of machine roll unreelers with appropriate adaptation of existing apparatus.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
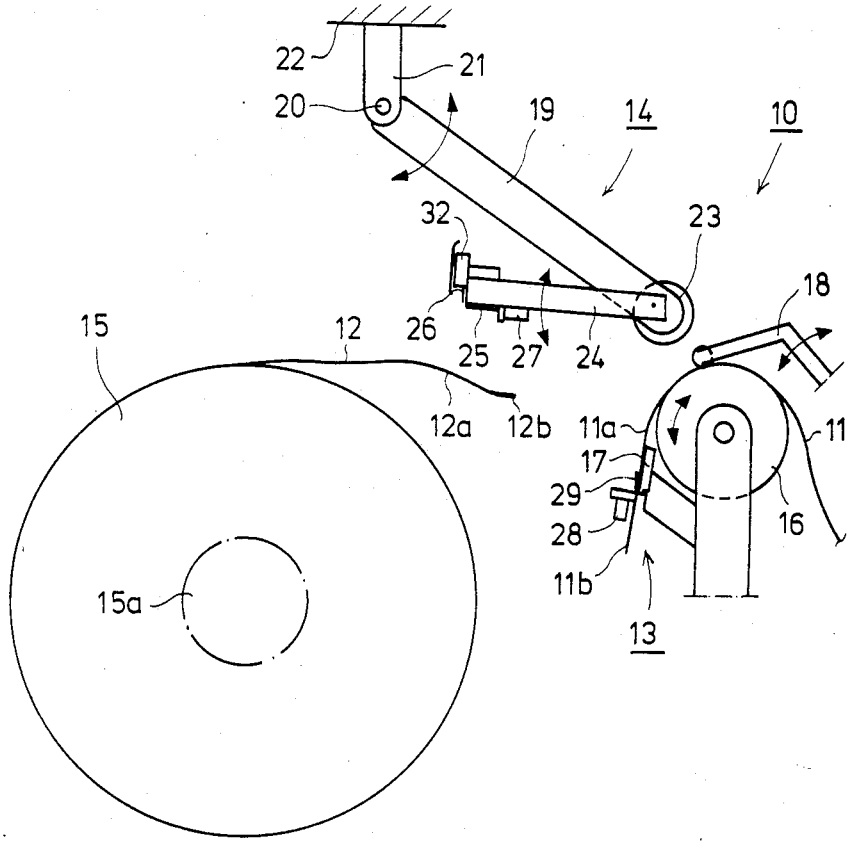
FIG. 1 is a schematic side elevation view of an embodiment of apparatus in accordance with the invention for practicing a method in accordance with the invention in a so-called topside running application.

Referring now to the drawings wherein like reference characters designate identical or corresponding parts throughout the several views, and more particularly to FIGS. 1–5, an advantageous embodiment of apparatus in accordance with the invention for performing a method in accordance with the invention is illustrated, the apparatus being generally designated 10. Apparatus 10 functions to join the end 11*a* of a first web 11 and the end 12*a* of a second web 12 to each other. The marginal region of the end 11*a* of web 11 is designated 11*b* while the marginal region of the end 12*a* of web 12 is designated 12*b*.

Generally, apparatus 10 comprises first locking means 13 for locking the end 11*a* of the first web 11 at a fixed position, and second holding and moving means 14 for holding the end 12*a* of web 12 and carrying the held end 12*a* into pressing engagement with the locked end 11a of the first web. In the illustrated embodiment, the web 11 is the so-called pulling web, while the web 12 which is wound on a machine roll 15 having an axle 15*a* is the so-called pulled web.

The first locking means 13 includes a guide roll 16, a suction box 17 having a planar suction surface 30 fixed in position relative to the axis of guide roll 16, and a pivotally mounted locking member 18 adapted to hold web 11 against the guide roll 16. The second holding and moving means 14 which acts on the end 12*a* of the web 12 includes a fetching arm 19, a suction roll 23 and a depressor arm 24 which supports a suction beam 25 at its end. The fetching arm 19 is pivotally mounted by bearings 20 to a support 21 which is fixed to the frame structure 24. The depressor arm 22 is pivotally mounted to the fetching arm 19 at one of its ends.

In addition to the suction beam 25, the depressor arm 24 also carries a cut-off blade 26 and a rotating cutter blade 27 adapted to traverse the width of the machine. In particular, referring to FIG. 4 wherein the depressor arm 24 is not shown for the sake of clarity, the cut-off blade 26 is operated by a pneumatic cylinder 32 or the like which functions intermittently to advance and retract the cut-off blade 26. The traversing cutter blade 27 is provided with its own drive motor 33 and traverses the width of the web by means of a suitable mechanism attached to the suction beam 25.

Figure 2:
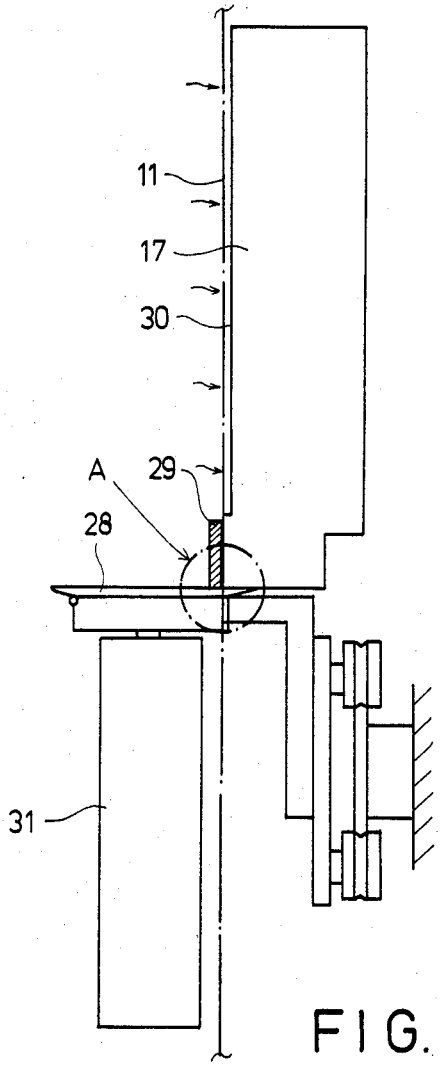
FIG. 2 is a schematic side elevation view on a larger scale than that used in FIG. 1 of components of first locking means of the embodiment illustrated in FIG. 1.
Figure 3:
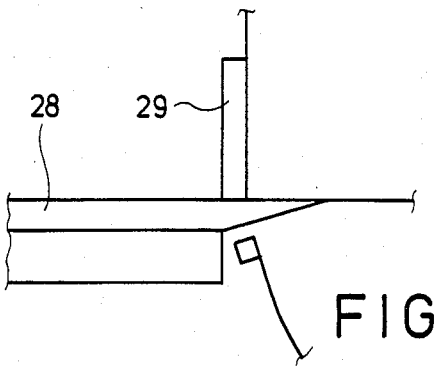
FIG. 3 is a schematic detail view of the area designated A in FIG. 2.

A rotating cutter blade 28 forms a part of the first locking means 13 and is adapted to traverse the width of the web by means of a suitable mechanism mounted on an appropriate frame component. The cutter blade 28 is provided with its own drive motor 31 and the edge of the suction box functions as a counterblade for the rotating cutter blade 28 as best seen in FIG. 2. It is not absolutely necessary to provide the cutter blades 27 and 28 with their own drive motors. For example, the cutter blades can be rotated under the friction forces generated by the contact between the blades and their respective counterblades.

Operation of the illustrated embodiment of the apparatus in accordance with an embodiment of a method of the invention will now be described.

Figure 4:
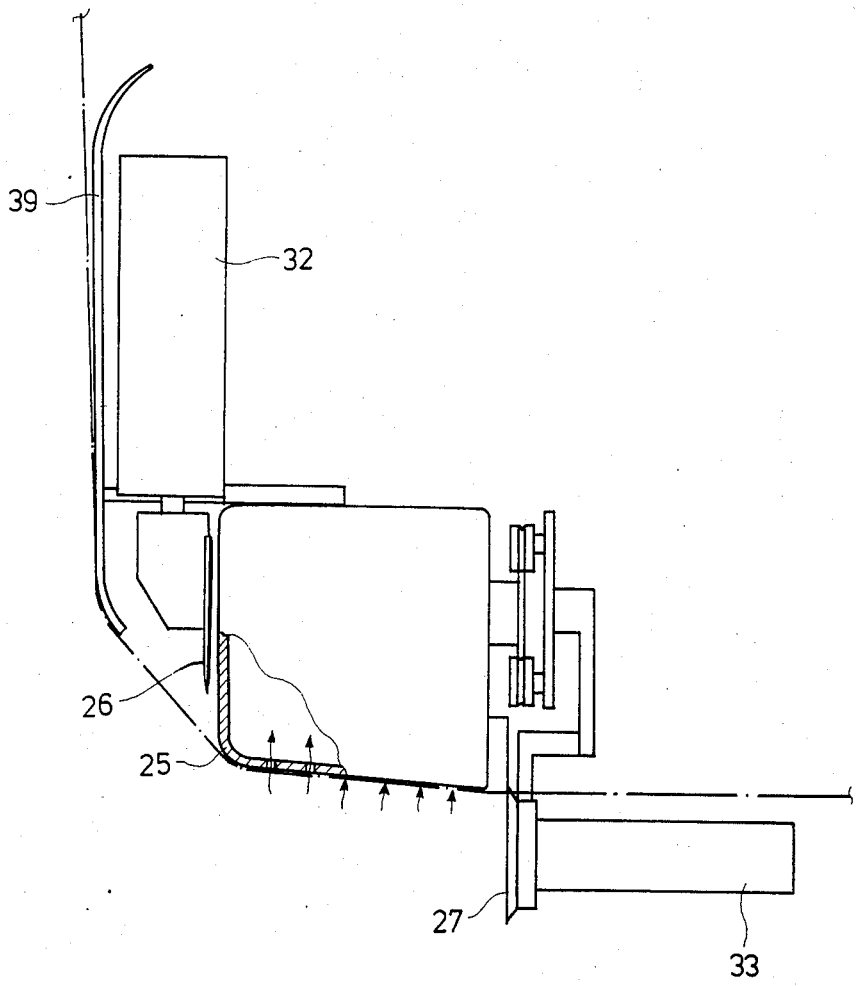
FIG. 4 is a schematic side elevation view of a larger scale than that used in FIG. 1 of components of second holding and moving apparatus of the embodiment of FIG. 1.
Figure 5A:
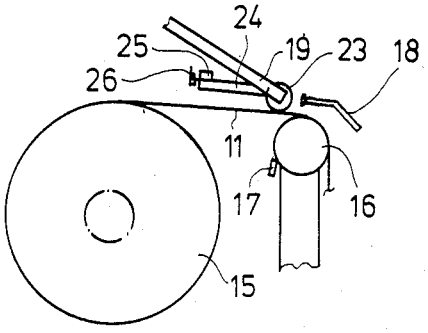
FIGS. 5*a*–5*i* are schematic views illustrating the sequence of operation of the apparatus of FIG. 1 in accordance with the method of the invention.
Figure 5B:
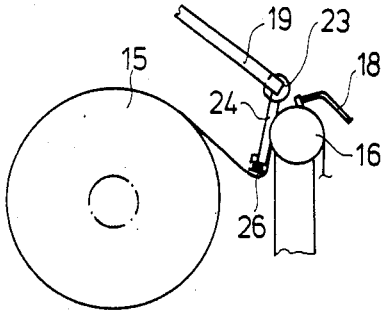

Referring to FIGS. 5*a*–5*i*, the method and apparatus of the invention are applied to joining the ends of webs in connection with changing the machine roll 15 of a longitudinal cutter. The longitudinal cutter is stopped in a controlled manner so that the web 11 remains taut as shown in FIG. 5*a* with the second helding and moving means 14 in a non-operative position above the web 11. The depressor arm 24 is pivoted so that a skid 39 (FIG. 4) mounted on the depressor arm engages the web 11. The depressor arm 24 continues its travel until the web 11 is pressed against the suction surface of the suction box 17 as shown in FIG. 5*b*. The locking member 18 is pressed against the web on the guide roll 16 and a vacuum is applied to the suction box 17 whereby the end of the web 11 adheres to the suction surface of box 17. The pneumatic cylinder 32 is then actuated to advance the cut-off blade 26 to cut the web 11 over its entire transverse width. The depressor arm is then pivoted back to its nonoperative position whereupon the condition illustrated in FIG. 1 is obtained with the web adhering to the suction box 17.

Damaged or low-quality paper courses can be removed from the web on the machine roll 15 at this stage or the entire machine roll 15 may be replaced with a roll having a fresh supply of web material to be joined to the web 11 which is locked in positon by the first locking means 13. An elongated strip of double-sided adhesive tape is applied across the width of the marginal region of the end of web 11 at the end of the suction surface of suction box 17. After the tape 29 is applied, the traversing cutter blade 28 is actuated to cut the tape 29 and the marginal region 11*b* of the end 11*a* of web 11. Alternatively, the cutter blade 28 may be arranged to cut the web along a line slightly below tape 29 in which case a tail of desired length will remain.

Figure 5C:
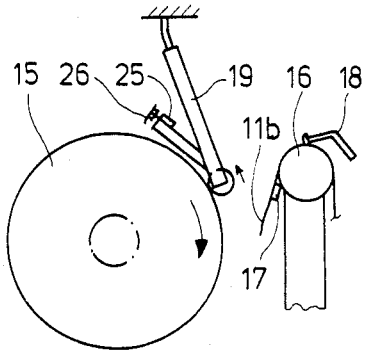
Figure 5D:
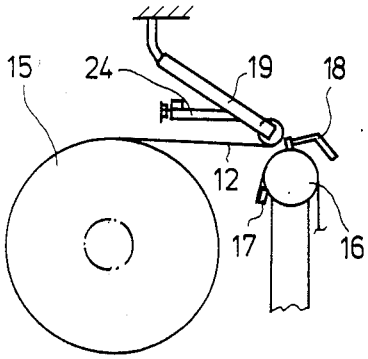

After discarding the low-quality paper courses or changing the machine roll 15, the fetching and depressor arms 19 and 24 are pivoted until the suction roll 23 is brought into contact with the web on the machine roll 15 as seen in FIG. 5*c*. The machine roll 15 is then rotated slowly until the end 12*a* of the web 12 engages the suction roll 23. Rotation of the machine roll 15 is stopped and a vacuum is applied to the suction roll 23 whereupon the end 12*a* of web 12 adheres to, i.e., is held by the surface of the outer shell of the suction roll 23 under the effects of the suction generated by the vacuum. If the web material to be joined is stiff, such for examle as cardboard, a two-sided adhesive tape may be applied to the end 12*a* of web 12 to insure that the web end adheres to the shell of the suction roll. The machine roll 15 is then rotated in a web-unwinding direction so that the unwinding web 12 becomes wound around the suction roll 23 to which a turning torque is applied. The web 12 is maintained in a taut condition at all times due to the torque applied to the suction roll 23. This operation continues until a few turns of the paper web 12 are wound on the suction roll 23 whereupon the machine roll 15 is stopped.

In the next stage of operation, the fetching arm 19 is pivoted upwardly so that the suction roll 23 holding the end of web 12 is removed from the machine roll 15 and reaches a position proximate to the guide roll 16. During the movement of the suction roll 23, the web 12 is pulled from the suction roll 23, the tension in the web 12 overcoming the torque applied to the suction roll 23 so that the web 12 unwinds from the suction roll during movement of the latter. In this manner, the web 12 is maintained under substantially uniform tension during movement of suction roll 23 to the position shown in FIG. 5*d*.

Figure 5E:
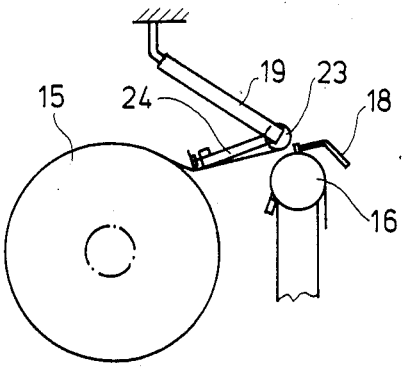

At this stage the depressor arm 24 is rotated so that the web 12 is engaged by the suction surface of the suction beam 25 and skid 39 as seen in FIGS. 4 and 5*e*. A vacuum is applied to the suction beam whereby the web 12 adheres to, i.e., is held by its suction surface under the effects of suction generated by the vacuum.

Figure 5F:
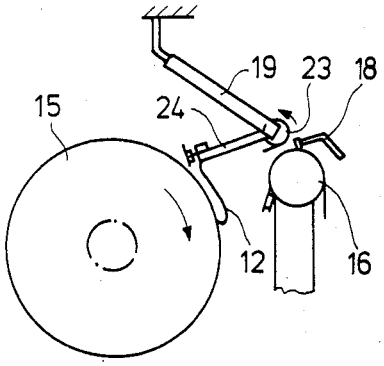

The machine roll 15 is then rotated to pay out a slackened length of web 12 extending between the machine roll and suction beam 25 to which the web 12 adheres. This condition is shown in FIG. 5*f*. The cutter blade 27 associated with the depressor arm 24 is actuated to traverse and cut the web 12 over its width and the free portion of the web is then rolled onto the suction roll 23 which rotates under the torque applied thereto as seen in FIG. 5*f*.

Figure 5G:
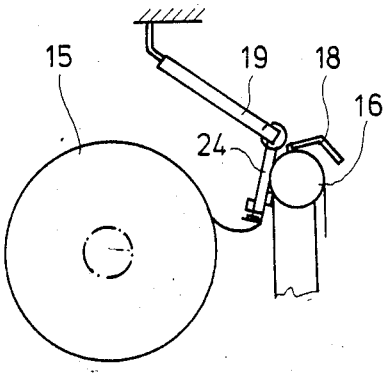

The depressor arm 24 is then rotated until the end 12*a* of the pulled web 12 is pressed against the adhesive tape 29 previously applied to the end 11a of the pulling web 11 on the suction box 17 whereby the marginal regions 11*b* and 12*b* of the ends 11*a* and 12*a* of the webs 11 and 12 form a lap joint, as seen in FIG. 5*g*.

Figure 5H:
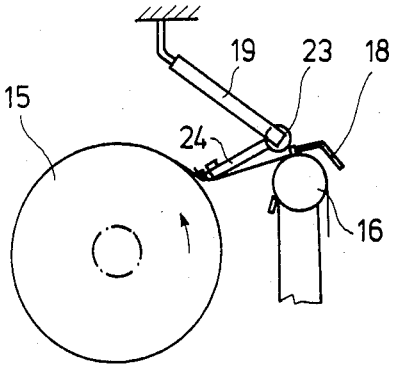

The vacuum is then removed from the suction beam 25 and suction box 17 and the machine roll 15 rotated in the opposite direction as indicated by the arrow in FIG. 5*h* to pull the joined web into a taut condition, the depressor arm 24 being raised under the effect of the web tensioning. The web remains taut due to the tensioning effect of the weight of the depressor arm 24 acting on the web as the machine roll 15 rotates.

Figure 5I:
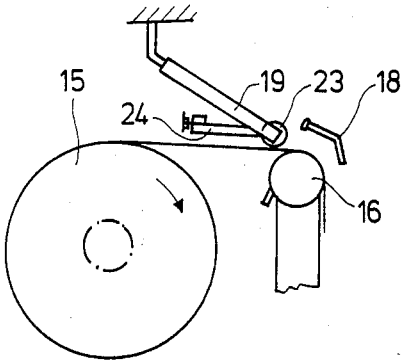

Finally, the locking member 18 is raised from the guide roll 16 and the longitudinal cutter is started to run initially at a low speed. The depressor arm 24 is slowly lifted to its non-operative position as shown in FIG. 5*i* and the longitudinal cutter is then brought up to normal running speed.

Figure 6:
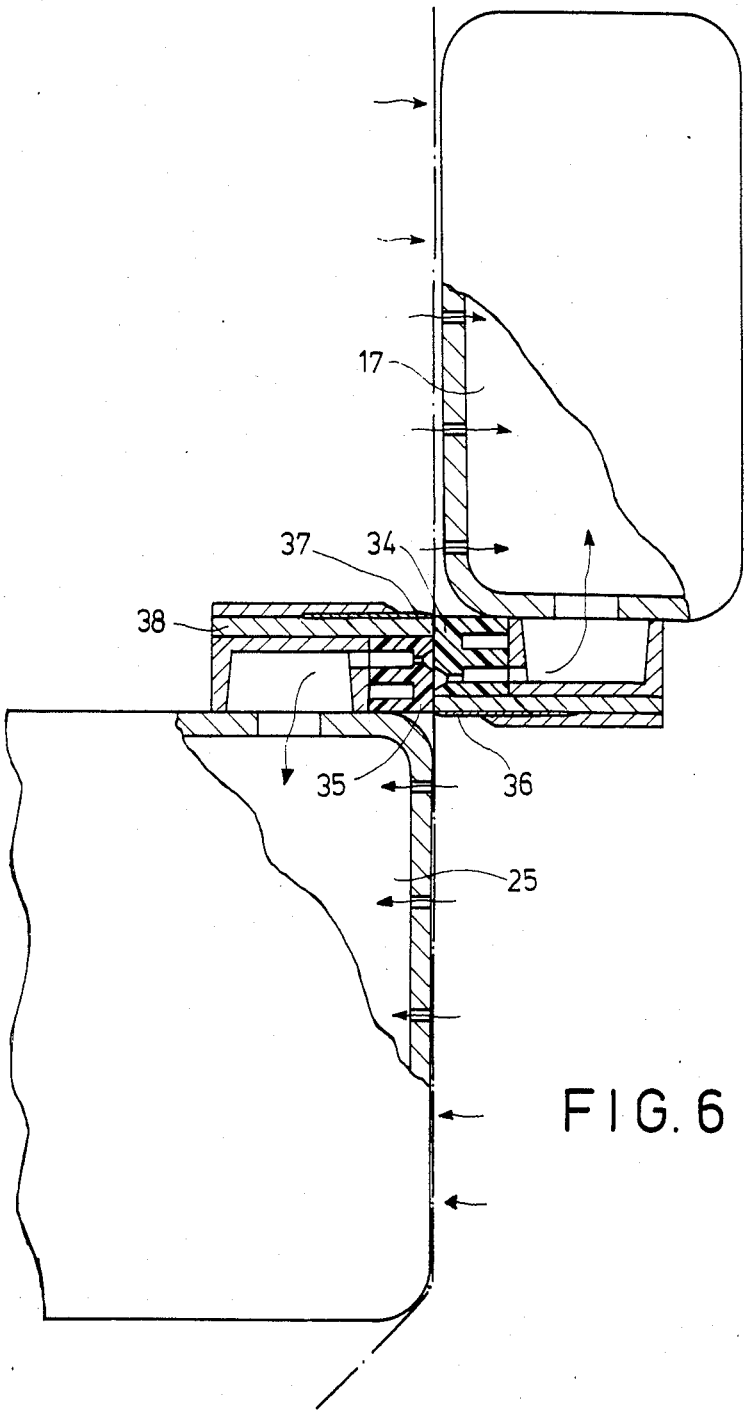
FIG. 6 is a schematic side elevation detail view of a modification of apparatus in accordance with the invention.

In the modification shown in FIG. 6, the suction box 17 is provided with an elastic, i.e. resilient, surface 34 while the suction beam 25 is provided with an elastic surface 35, the elastic surfaces 34 and 35 adapted to come into mutually opposed relationship as seen in FIG. 6 when the depressor arm 24 is rotated to the position shown in FIG. 5*g*. Counterblades 36 and 37 are provided on the suction box 17 and suction beam 25 respectively. A metallic member 38 is preferably provided adjacent to the elastic surface 35 associated with the suction beam 25 which comes into opposed relationship with the elastic or resilient surface 34. The use of the elastic surfaces 34, 35 is advantageous in that a better quality joint is achieved between the web ends as compared to the case in which the surfaces 34, 35 are not formed of elastic material. The mating or joining surfaces 34 and 35 can be formed of any suitable resilient materials such, for example, as urethane rubber, and provides a substantially constant and uniform joining pressure over the entire area of the joint. A relatively high quality joint can also be obtained when only one of the surfaces 34 and 35 is elastic. However, formation of both of the surfaces 34 and 35 from elastic material is preferred.

The apparatus and method of the invention have been described in the foregoing as utilizing a double-sided joining tape to form a lap joint. It will be understood that the joining tape may also be applied so that a butt joint is obtained between the ends of the webs. Indeed, the use of a joining tape is not absolutely necessary and other joining means such, for example, as glue or the like can be used so long as a reliable joint is obtained.

The position of the mating or joining surfaces of the sucton beam 25 and suction box 17 relative to each other can be varied within the scope of the invention to enable the lengths of the web tails to be taken into account. For example, the point at which the joining tape 29 is applied at the suction box 17 will determine the length of the tail 11*b* of the web 11. On the other hand, the length of the tail of web 12 can be adjusted by suitably positioning the line at which the cutter blade 27 cuts the web 12.

The method and apparatus of the invention can be utilized to form a joint which runs in an oblique direction with respect to the transverse direction of the web. This can be a significant advantage, especifically where the invention is utilized in printing applications.

Obviously, numerous modifications and variations of the present invention are possible in the light of the above teachings. It is therefore to be understood that within the scope of the claims sppended hereto, the invention may be practiced otherwise than as specially disclosed herein.

What is claimed is:

1. Apparatus for joining an end of a first web to an end of a second web comprising:

first locking means for locking the end of the first web at a first location, said first locking means comprising a guide roll, a fixedly mounted suction box having a suction surface and a locking member for locking the first web against said guide roll; and second holding and moving means for holding the end of the second web and moving the held end of the second web into contact with the end of the first web, said ends of the first and second webs being mutually disposed to form a joint with each other, said second holding and moving means comprising fetching arm means, a suction roll mounted at one end of said fetching arm means, a depressor arm turnably mounted to said fetching arm means, and a suction beam mounted on said depressor arm.

2. The combination of claim 1 wherein said fetching arm means are pivotally mounted to fixed frame structure at an end opposite from the end at which said suction roll is mounted.

3. The combiantion of claim 1 wherein said second holding and moving means include a selectively actuatable cut-off blade.

4. The combination of claim 1 wherein said second holding and moving means include a rotatable cutter blade mounted for traverse cutting movement across the width of the second web.

5. The combination of claim 1 wherein said first locking means include a rotatable cutter blade mounted for transverse cutting movement across the width of the first web.

6. The combination of claim 1 wherein at least one of said first locking and second holding and moving means include a resilient surface for holding the ends of the first and second webs in contact with each other under a substantially uniform pressure.

7. The combination of claim 6 wherein said first locking means include a suction box and said second holding and moving means comprise a suction beam, and wherein said at least one resilient surface is applied to a respective one of said suction box and suction beam.

8. Appartus for joining an end of a first web to an end of a secod web of a web roll comprising:

first suction surface means for locking the end of the first web at a first location;

a suction roll;

means for moving the suction roll into engagement with the second web on the web roll and winding a length of the second web onto the suction roll;

means for moving the suction roll with the length of the second web wound thereon to a position remote from the web roll so that an extended length of the second web extends between said suction roll and the web roll;

second suction surface means associated with said suction roll for holding a portion of the extended length of the second web;

means for cutting the second web over its transverse width along a line situated between said second suction surface and said suction roll whereby said portion of said extended length of the second web held by said second suction surface constitutes the end of the second web; and means for moving said second suction surface means and the end of the second web held by it to the first location and pressing the end of the second web against the end of the first web.

9. The combination of claim 8 wherein said suction roll moving means include means for moving the suction roll to a position remote from the web roll so that said length of the second web extending between said suction roll and the web roll is maintained under a substantially constant tension.

10. Apparatus for joining an end of a first web to an end of a second web comprising:

first locking means for locking the end of the first web at a first location; and second holding and moving means for holding the end of the second web and moving the held end of the second web into contact with the end of the first web, said ends of the first and second webs being mutually disposed to form a joint with each other, said second holding and moving means including means for maintaining a substantially constant tension in the second web wherein said first locking means include means for supporting said first web, a suction box having a suction surface, and a locking member for locking the first web against said supporting means.

11. Apparatus for joining an end of a first web to an end of a second web, comprising:

first locking means for locking the end of the first web at a first location; and second holding and moving means for holding the end of the second web and moving the held end of the second web into contact with the end of the first web, said ends of the first and second web being mutually diposed to form a joint with each other, said second holding and moving means comprising fetching arm means, a suction roll mounted at one end of said fetching arm means, a depressor arm turnably mounted to said fetching arm means, and a suction beam mounted on said depressor arm.

* * * * *